US011241885B2

(12) United States Patent
Shigeta

(10) Patent No.: US 11,241,885 B2
(45) Date of Patent: Feb. 8, 2022

(54) SYSTEM AND METHOD FOR DETECTING AMOUNT OF INK USED BY INKJET PRINTER AND INKJET PRINTER

(71) Applicant: THINK LABORATORY CO., LTD., Chiba (JP)

(72) Inventor: Tatsuo Shigeta, Chiba (JP)

(73) Assignee: THINK LABORATORY CO., LTD., Chiba (JP)

( * ) Notice: Subject to any disclaimer, the term of this patent is extended or adjusted under 35 U.S.C. 154(b) by 0 days.

(21) Appl. No.: 16/978,423

(22) PCT Filed: Feb. 18, 2019

(86) PCT No.: PCT/JP2019/005785
§ 371 (c)(1),
(2) Date: Sep. 4, 2020

(87) PCT Pub. No.: WO2019/171924
PCT Pub. Date: Sep. 12, 2019

(65) Prior Publication Data

US 2021/0039397 A1 Feb. 11, 2021

(30) Foreign Application Priority Data

Mar. 5, 2018 (JP) ..... JP2018-038648

(51) Int. Cl.
*B41J 2/175* (2006.01)
*B41J 3/46* (2006.01)
*B41J 11/02* (2006.01)

(52) U.S. Cl.
CPC ..... *B41J 2/17546* (2013.01); *B41J 3/46* (2013.01); *B41J 11/02* (2013.01)

(58) Field of Classification Search
CPC ..... B41J 2/175; B41J 2/1752; B41J 2/17546; B41J 2/17566; B41J 2/17596; B41J 3/46;
(Continued)

(56) References Cited

U.S. PATENT DOCUMENTS 4,962,666 A * 10/1990 Adney ..... G01F 1/007 73/1.31
7,370,948 B2 5/2008 Inoue
(Continued)

FOREIGN PATENT DOCUMENTS

JP 2004-209706 A 7/2004
JP 2005-161131 A 6/2005
(Continued)

*Primary Examiner* — Anh T Vo
(74) *Attorney, Agent, or Firm* — McGlew and Tuttle, P.C.

(57) ABSTRACT

Provided are a system and method of detecting an ink use amount of an inkjet printer, which allow detection of an ink use amount of an inkjet printer configured to perform image forming by discharging an inkjet ink on a web-shaped print base material by a single-pass method, and an inkjet printer. A system of detecting an ink use amount of an inkjet printer configured to perform image forming by discharging an inkjet ink on a web-shaped print base material by a single-pass method, includes: an ink tank mass measuring device configured to measure a mass of an ink tank; a comparison operation device configured to perform a comparison operation between a setting reference value of an ink use amount, which is prepared in advance, and a use amount measurement value of the ink tank mass measuring device; and a display device configured to display a warning when a difference between the use amount measurement value and the setting reference value exceeds a range set in advance.

5 Claims, 5 Drawing Sheets

(58) Field of Classification Search
CPC ... B41J 11/02; B41J 29/38; B41J 2002/17569
See application file for complete search history.

(56) References Cited

U.S. PATENT DOCUMENTS

| | | | | |
|---|---|---|---|---|
| 2005/0156954 | A1* | 7/2005 | Silverbrook ..... | B41J 11/70 347/2 |
| 2009/0322808 | A1 | 12/2009 | Mitchell et al. | |
| 2016/0023472 | A1 | 1/2016 | Arizono et al. | |

FOREIGN PATENT DOCUMENTS

| | | | |
|---|---|---|---|
| JP | 2016-28853 | A | 3/2016 |
| JP | 2017-65138 | A | 4/2017 |
| WO | 2017/110441 | A1 | 6/2017 |

* cited by examiner

SYSTEM AND METHOD FOR DETECTING AMOUNT OF INK USED BY INKJET PRINTER AND INKJET PRINTER

TECHNICAL FIELD

The present invention relates to a system and method of detecting an ink use amount of an inkjet printer configured to perform image forming on a web-shaped print base material by a single-pass method with an inkjet ink, and to an inkjet printer.

BACKGROUND ART

Methods of performing printing while continuously conveying a print base material include a scanning method and a single-pass method. The single-pass method is more suitable for high-speed printing especially in the case of performing printing while continuously conveying the web-shaped print base material because there is no need to perform scanning. As an inkjet printer configured to perform image forming by a single-pass method with an inkjet ink, there has been known, for example, an inkjet printer described in Patent Document 1.

In the case of the inkjet printer as described in Patent Document 1, unlike the inkjet printer employing the scanning method, an amount of use of ink of each color is increased because a large volume of printing is performed at high speed. Further, a tank having a large capacity is also required, and it is general to use, for example, a large-sized tank having a capacity of 20 L or more.

In such an apparatus, the ink use amount is large at the time of printing, and hence, even when ink is leaking from any portion of the apparatus configuration, it has been quite difficult to notice the leakage. In the related art, whether or not the ink use amount of the tank is abnormal has been confirmed by visual observation.

For example, when the remaining ink amount is detected in the inkjet printer employing the scanning method to perform printing on paper or the like, various optical sensors and the like are used to detect the remaining ink amount and the like.

However, when the tank is increased in size, a liquid surface of the ink ripples even with a small vibration applied to the tank. Therefore, an error is liable to occur when the detection is performed only by the above-mentioned optical sensors and the like.

Further, in the inkjet printer configured to perform image forming on the web-shaped print base material by the single-pass method with the inkjet ink, the apparatus has a configuration of continuously conveying the base material, and hence it is difficult to directly apply a detecting technology of the inkjet printer employing the scanning method, which has a different configuration.

PRIOR ART DOCUMENT

Patent Document

Patent Document 1: WO 2017/110441

DISCLOSURE OF THE INVENTION

Problems to be Solved by the Invention

The present invention has an object to provide a system and method of detecting an ink use amount of an inkjet printer, which allow detection of an ink use amount of an inkjet printer configured to perform image forming by discharging an inkjet ink on a web-shaped print base material by a single-pass method, and also to provide an inkjet printer.

Means for Solving Problems

In order to solve the above-mentioned problem, a system of detecting an ink use amount of an inkjet printer according to the present invention is a system of detecting an ink use amount of an inkjet printer configured to perform image forming by discharging an inkjet ink on a web-shaped print base material by a single-pass method, the system of detecting an ink use amount including: an ink tank mass measuring device configured to measure a mass of an ink tank; a comparison operation device configured to perform a comparison operation between a setting reference value of an ink use amount, which is prepared in advance, and a use amount measurement value of the ink tank mass measuring device; and a display device configured to display a warning when a difference between the use amount measurement value and the setting reference value exceeds a range set in advance.

It is preferred that the setting reference value be calculated based on an ink volume or an ink mass.

An inkjet printer according to the present invention is an inkjet printer including: the above-mentioned system of detecting an ink use amount; a conveyance mechanism configured to continuously convey the web-shaped print base material; a single-pass inkjet head configured to discharge an inkjet ink on a surface of the web-shaped print base material conveyed by the conveyance mechanism; and a curing device configured to cure the inkjet ink discharged on the surface of the web-shaped print base material.

A method of detecting an ink use amount of an inkjet printer according to the present invention is a method of detecting an ink use amount of an inkjet printer configured to perform image forming by discharging an inkjet ink on a web-shaped print base material by a single-pass method, the method of detecting an ink use amount including: preparing in advance a setting reference value of an ink use amount; measuring a mass of an ink tank by an ink tank mass measuring device; performing a comparison operation between the setting reference value of the ink use amount and a use amount measurement value of the ink tank mass measuring device; and displaying a warning when a difference between the use amount measurement value and the setting reference value exceeds a range set in advance.

It is preferred that the setting reference value be calculated based on an ink volume or an ink mass.

The printing with an inkjet printer involves forming a digital image with a dot group of discharged ink droplets, and hence the image forming corresponds to forming a digital image with a dot group of discharged ink droplets.

As the web-shaped print base material, a nontransparent web-shaped print base material such as paper or nonwoven fabric beside a transparent film can also be applied. As a transparent-film web-shaped print base material, for example, a transparent film using a web-shaped synthetic resin film, such as polyethylene terephthalate (PET), polyvinyl chloride (PVC), or polypropylene (PP), can be suitably used.

Advantageous Effects of the Invention

The present invention exhibits the remarkable effect that it is possible to provide the system and method of detecting an ink use amount of an inkjet printer, which allow detection of the ink use amount of the inkjet printer configured to perform image forming by discharging the inkjet ink on the web-shaped print base material by the single-pass method, and also to provide the inkjet printer.

DESCRIPTION OF EMBODIMENTS

An embodiment of the present invention is described below. However, the embodiment is described by way of example, and needless to say, the present invention can be modified in various ways unless departing from the technical idea of the present invention. The same components are denoted by the same reference symbols.

Figure 1:
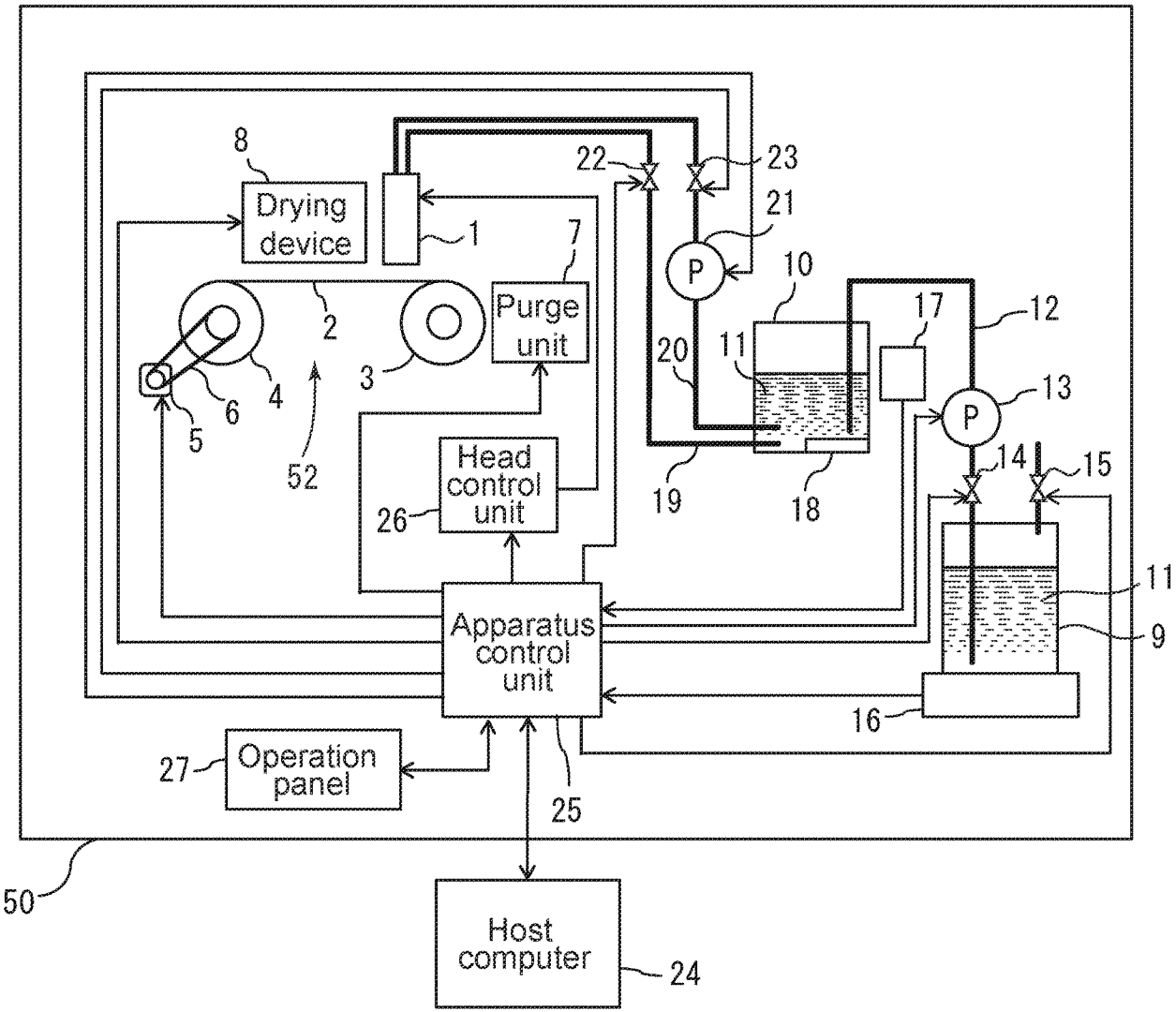
FIG. 1 is a schematic view for illustrating one embodiment of an inkjet printer including a system of detecting an ink use amount of the present invention.

FIG. 1 is a schematic view for illustrating one embodiment of an inkjet printer including a system of detecting an ink use amount of the present invention. In FIG. 1, reference symbol 50 denotes an inkjet printer of the present invention. The inkjet printer 50 is an inkjet printer including a single-pass inkjet head 1 as described in Patent Document 1, and is configured to perform image forming by discharging an inkjet ink on a web-shaped print base material by a single-pass method.

The inkjet printer 50 is an inkjet printer including: a conveyance mechanism 52 configured to continuously convey a web-shaped print base material 2; the single-pass inkjet head 1 configured to discharge an inkjet ink on a surface of the web-shaped print base material 2 conveyed by the conveyance mechanism 52; and a curing device 8 configured to cure the inkjet ink discharged on the surface of the web-shaped print base material 2.

The inkjet ink used in the present invention is not particularly limited. Any publicly known inkjet ink can be used, but an aqueous ink or an ultraviolet (UV) curable ink is preferred. In particular, an aqueous ink is suitably used.

The illustrated example is an example in which an aqueous ink is used as the inkjet ink, and hence an example in which the drying devices are used as the curing device 8 configured to cure inkjet inks is given. When an UV curable ink is used as the inkjet ink, an ultraviolet irradiation device may be provided instead of the drying device.

In the single-pass inkjet head 1, as described in Patent Document 1, inkjet heads of different colors are fixed in parallel to each other so that the printing can be completed through one passage of the continuously conveyed web-shaped print base material 2. Various publicly known single-pass inkjet heads are applicable to the single-pass inkjet head 1. The inkjet head 1 includes a plurality of inkjet heads corresponding to each color of white (W), yellow (Y), magenta (M), cyan (C), and black (K).

The conveyance mechanism 52 includes: a feed roll 3 around which the web-shaped print base material 2 is wound in a roll shape; a take-up roll 4 configured to take up the web-shaped print base material 2 having the inkjet ink discharged on its surface; a conveyance motor 5 configured to rotate the take-up roll 4; and a drive transmitting unit 6 configured to transmit a drive force of the conveyance motor 5 to the take-up roll 4.

Reference symbol 7 denotes a purge unit configured to perform maintenance of the inkjet head 1. When the maintenance is performed, the inkjet head 1 is moved by a mechanism (not shown) to the position of the purge unit 7.

The drying device 8 is configured to, as described above, dry ink droplets of the aqueous ink discharged from the inkjet head 1 onto the surface of the web-shaped print base material 2. As the drying device 8, any publicly known drying device is applicable as long as the drying device can dry the ink droplets of the aqueous ink on the surface of the web-shaped print base material 2. For example, the following configuration can be employed. That is, the web-shaped print base material 2 is passed through a heating box having heat insulating structure, and the ink droplets of the aqueous ink on the surface of the web-shaped print base material 2 are dried through heating by warm air or various publicly known heaters.

Reference symbol 9 denotes a main tank for storing an inkjet ink to be discharged from the inkjet head 1, and a sub-tank 10 is provided in the middle of an ink supply path from the main tank 9 to the inkjet head 1. Reference symbol 11 denotes an inkjet ink to be supplied.

As a supply path 12 for supplying the inkjet ink from the main tank 9 to the sub-tank 10, a supply tube is provided. A supply pump 13 is provided in the middle of the supply path 12.

Reference symbol 14 denotes a first solenoid valve configured to open and close the supply path 12, and reference symbol 15 denotes a second solenoid valve functioning as an atmospheric relief valve to bring the internal pressure of the main tank 9 to the atmospheric pressure.

Figure 2:
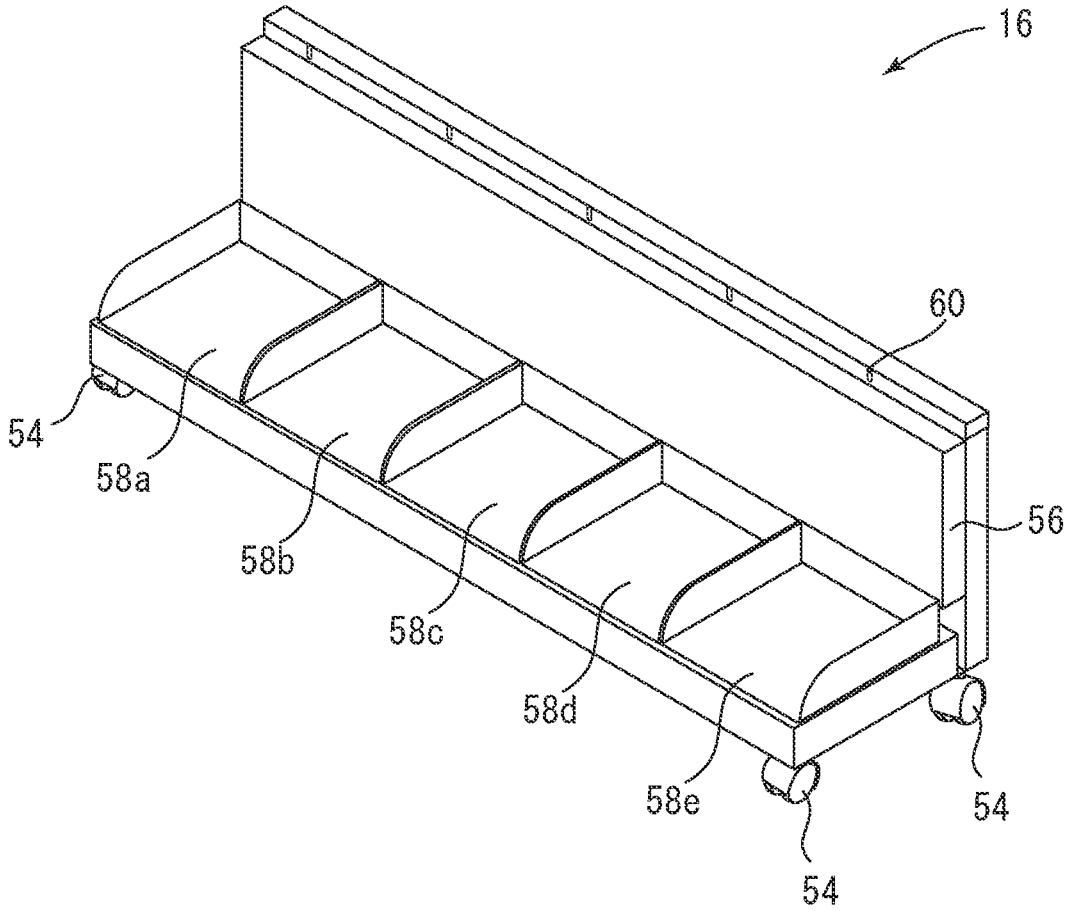
FIG. 2 is a perspective view for illustrating one embodiment of an ink tank mass measuring device of the system of detecting an ink use amount of the present invention.
Figure 3:
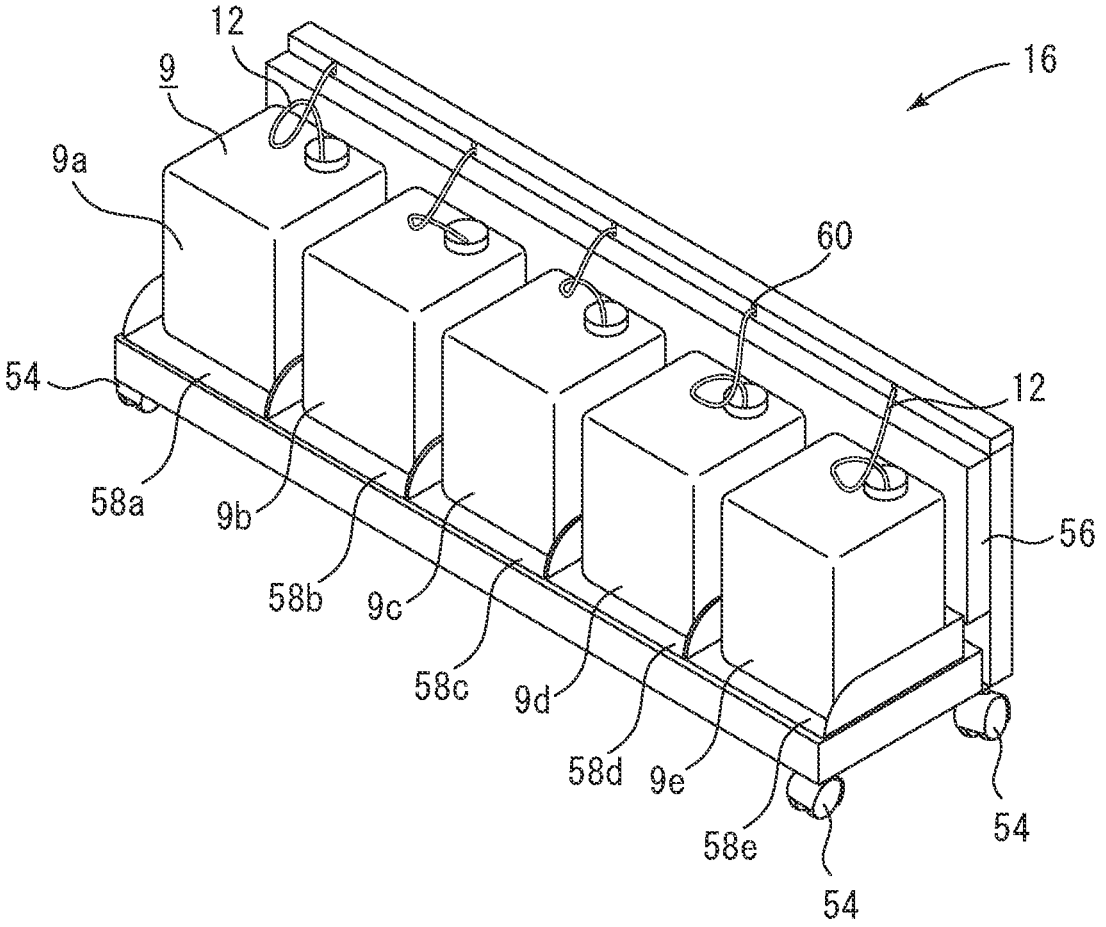
FIG. 3 is a perspective view for illustrating a state in which ink tanks are placed on the ink tank mass measuring device of FIG. 2.

Reference symbol 16 denotes an ink tank mass measuring device configured to measure the weight of the main tank 9. As the main tank 9, in the illustrated example, there is given an example of a tank having a capacity of 20 L. Further, as the ink tank mass measuring device 16, it is preferred to employ a mass measuring device using a load cell. In FIG. 2 and FIG. 3, as the ink tank mass measuring device 16, an example of the ink tank mass measuring device using the load cell is illustrated in detail.

In FIG. 2 and FIG. 3, the ink tank mass measuring device 16 has structure in which a plurality of ink tank scales 58*a* to 58*e* are installed on a base 56 having casters 54 mounted thereon. The ink tank scales 58*a* to 58*e* are load cells. In an upper portion of the base 56, tube insertion holes 60 through which the supply paths 12 are allowed to pass are also formed. As described above, the ink tank mass measuring device 16 is movable by the casters 54, and hence the main tank 9 can be easily moved even when, for example, a plurality of large-sized ink tanks each having a capacity of 20 L and containing an inkjet ink are arranged side by side.

In FIG. 2 and FIG. 3, there is given an example in which the main tank 9 includes a main tank 9*a* for white (W), a main tank 9*b* for yellow (Y), a main tank 9*c* for magenta (M), a main tank 9*d* for cyan (C), and a main tank 9*e* for black (K), which each contains an inkjet ink of a corresponding color.

Further, as illustrated in FIG. 3, the plurality of main tanks 9*a* to 9*e* corresponding to the main tank 9 are placed on the ink tank scales 58*a* to 58*e*, respectively, so that the mass of each of the main tanks 9*a* to 9*e* can be measured in units of 0.1 g. The sub-tank 10 is provided so as to correspond to the main tank 9. Although not shown, as the sub-tank 10, a plurality of sub-tanks are provided so as to correspond to the plurality of main tanks 9*a* to 9*e*.

Further, in FIG. 1, reference symbol 17 denotes a sub-tank liquid level sensor, which is formed of an optical element, and is used to keep an ink amount of the inkjet ink of the sub-tank 10 constant. When the sub-tank liquid level sensor 17 detects that the ink liquid surface in the sub-tank 10 is lower than a predetermined position due to ink consumption along with printing by the inkjet head 1, the first solenoid valve 14 and the second solenoid valve 15 are brought into an open state, and the supply pump 13 is activated to supply the inkjet ink 11 in the main tank 9 to the sub-tank 10. At this time, the internal pressure of the main tank 9 is kept to the atmospheric pressure because the second solenoid valve 15 is opened.

Further, a sub-tank heater 18 is provided to the sub-tank 10 so that the temperature of the inkjet ink 11 to be supplied to the inkjet head 1 is maintained constant. Reference symbols 19 and 20 denote circulation supply paths for circulating the inkjet ink between the sub-tank 10 and the inkjet head 1. A circulation pump 21, a third solenoid valve 22, and a fourth solenoid valve 23 are provided in the middle of the circulation supply paths 19 and 20. When the third solenoid valve 22 and the fourth solenoid valve 23 are opened, and the circulation pump 21 is activated, the inkjet ink 11 maintaining a constant ink temperature is supplied to the inkjet head 1.

Further, in FIG. 1, reference symbol 24 denotes a host computer configured to transmit discharge data for printing to the inkjet printer 50. Reference symbol 25 denotes an apparatus control unit configured to control the operation of the inkjet printer 50. Reference symbol 26 denotes a head control unit configured to drive the inkjet head 1 based on the discharge data for printing, which is generated by the apparatus control unit 25. Reference symbol 27 denotes an operation panel including a display unit configured to display the state of the inkjet printer 50.

Figure 4:
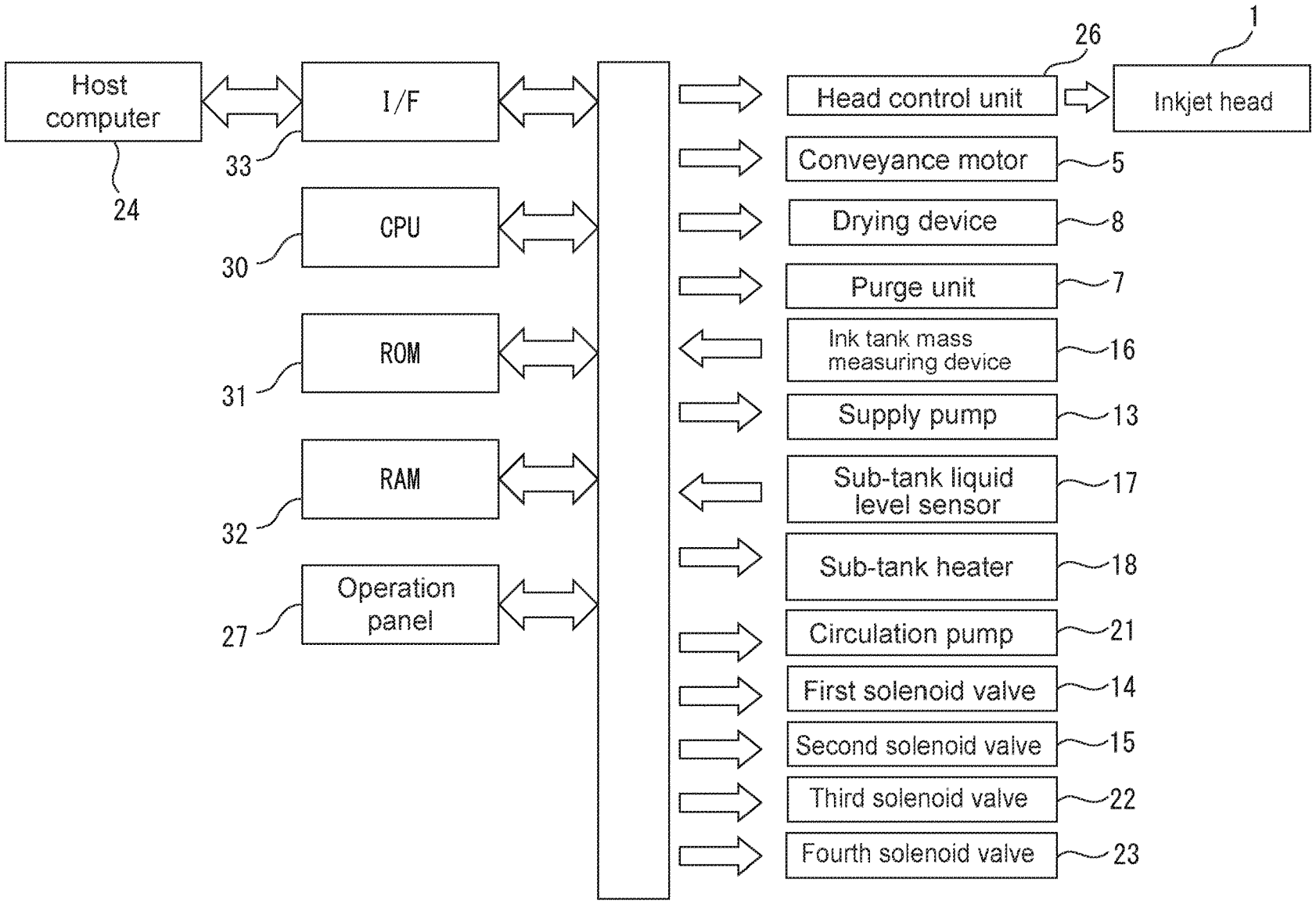
FIG. 4 is a functional block diagram of the inkjet printer including the system of detecting an ink use amount of the present invention.

The action of the apparatus control unit 25 is described with reference to FIG. 4. Reference symbol 30 denotes a central processing unit (CPU) configured to perform overall control of the apparatus control unit 25, and reference symbol 31 denotes a read only memory (ROM) configured to store an operation program of the CPU 30.

Reference symbol 32 denotes a random access memory (RAM) having a work area such as a print buffer, and reference symbol 33 denotes an interface unit configured to receive image data transmitted from the host computer 24. The image data received from the host computer 24 is converted and stored, by the CPU 30, as discharge data for discharging the inkjet ink 11 from the inkjet head 1, on the print buffer of the RAM 32 based on the operation program stored in the ROM 31. At the time of printing, the inkjet ink 11 of each color is discharged from the inkjet head 1 based on this discharge data, and printing is performed on the surface of the web-shaped print base material 2 serving as a medium to be printed.

In the illustrated example, the CPU 30 corresponds to a comparison operation device in the system of detecting an ink use amount of the present invention. The comparison operation device is configured to perform a comparison operation between a setting reference value of the ink use amount, which is prepared in advance, and a use amount measurement value of the ink tank mass measuring device 16. Further, the operation panel 27 corresponds to a display device in the system of detecting an ink use amount of the present invention. The display device is configured to display a warning when a difference between the use amount measurement value and the setting reference value exceeds a range set in advance.

Figure 5:
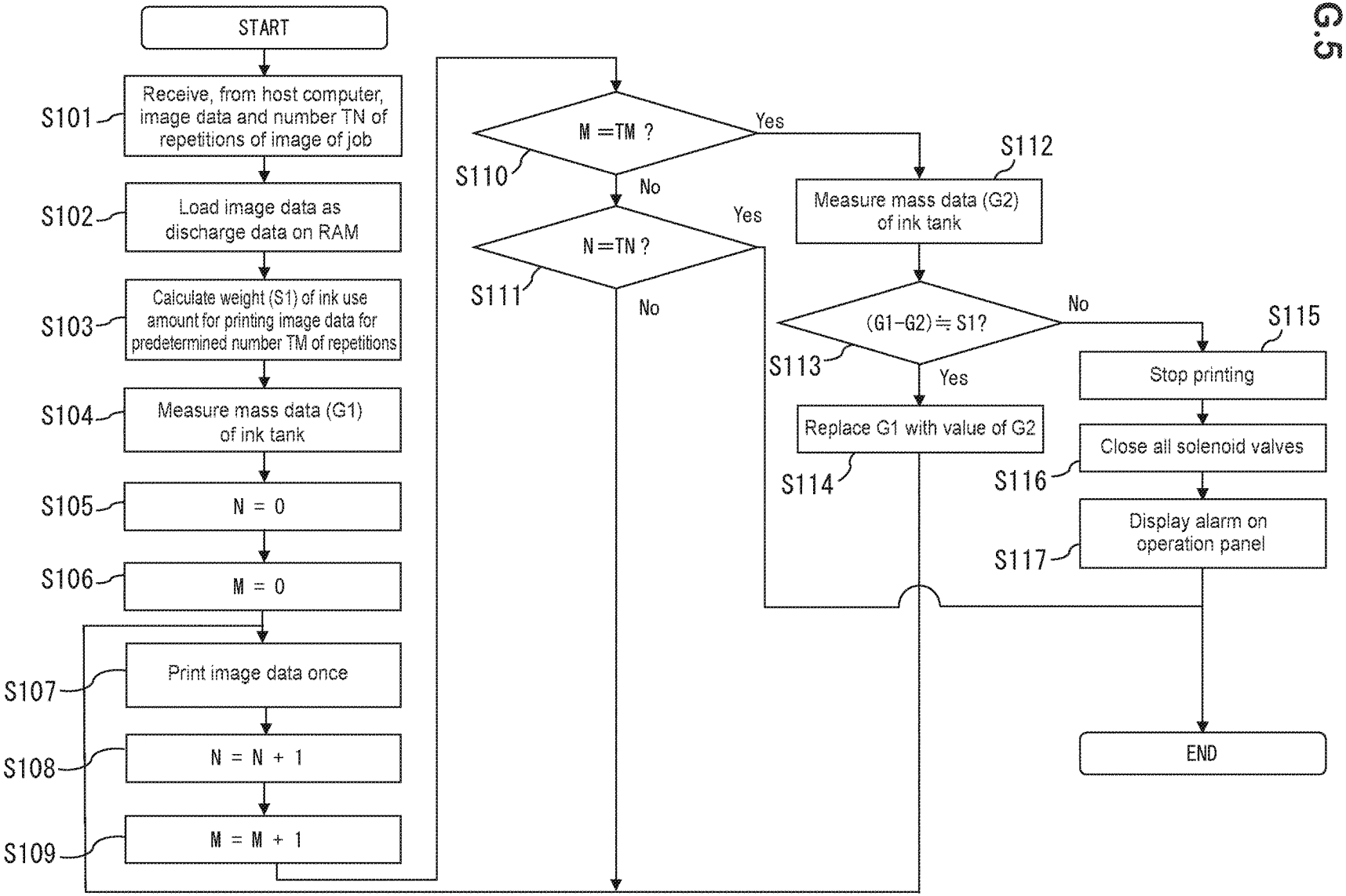
FIG. 5 is a flow chart for illustrating an operation sequence of the system of detecting an ink use amount of the inkjet printer of the present invention.

FIG. 5 is a flow chart for illustrating an operation sequence of the system of detecting an ink use amount of the inkjet printer 50 of the present invention, when a print job for repeating the same image for a plurality of times is printed on the web-shaped print base material.

First, when the printing operation is started, the inkjet printer 50 receives, from the host computer 24, the image data and the number TN of repetitions of the image of the print job, as data (S101).

The CPU 30 converts the received image data into discharge data for printing, for discharging the inkjet ink from the inkjet head 1, to thereby load the discharge data for printing on the RAM 32 (S102). Then, the CPU 30 calculates a weight S1 of the ink use amount to be used for printing the image data for a predetermined number TM of repetitions, which is smaller than the number TN of repetitions of the image of the print job, based on the discharge data loaded on the RAM 32 through use of mass data of a discharge ink droplet, which is stored in advance. The CPU 30 stores this weight S1 in the work area on the RAM 32 as the setting reference value of the ink use amount (S103).

Next, the CPU 30 receives mass data G1 of the main tank 9 (in the illustrated example, each of the main tanks 9*a* to 9*e*) from the ink tank mass measuring device 16, to thereby store the mass data G1 in the work area set in the RAM 32 (S104).

Next, the inkjet head 1 (plurality of inkjet heads corresponding to each color of white (W), yellow (Y), magenta (M), cyan (C), and black (K)) and the conveyance motor 5 are activated so that printing is performed on the surface of the web-shaped print base material 2 serving as the medium to be printed.

When the printing is performed, with reference to a cumulative number N of repetitions of the image from the start of the printing and the number M of repetitions that is reset for each predetermined number TM of repetitions, it is determined whether or not the step (S107) of printing once the image data of the print job has reached the predetermined number TM of repetitions, or has reached the number TN of repetitions of the image of the print job (S105 to S111).

When the printing reaches the predetermined number TM of repetitions, the ink tank mass measuring device 16 (each of the ink tank scales 58*a* to 58*e*) measures the weight of the main tank 9 (each of the main tanks 9*a* to 9*e*), and the weight is stored in the RAM 32 as mass data G2 (S112). After that, an ink mass (G1-G2) consumed from the main tank 9 in order to print the image data for the predetermined number TM of repetitions is calculated. The ink mass (G1-G2) is set as the use amount measurement value of the ink tank mass measuring device 16, while the weight S1 of the ink use amount calculated based on the discharge data calculated in advance is set as the setting reference value of the ink use amount. Those values are subjected to a comparison operation (S113).

When the difference [(G1-G2)−S1] between those two values is within a range set in advance (for example, the difference between those two values falls within ±5%), the printing is continued as it is. When the difference between those two values exceeds the range set in advance, the printing is stopped as operation abnormality, and the first solenoid valve 14, the second solenoid valve 15, the third solenoid valve 22, and the fourth solenoid valve 23 are all closed. Then, an alarm is displayed on the operation panel 27 (S115 to S117).

Further, although not shown in FIG. 5, when the value of (G1-G2) is smaller than S1, it means that the amount of ink discharged from the inkjet head 1 is small. Therefore, the printing may be stopped because the inkjet head 1 requires maintenance. The purge unit 7 may automatically perform the maintenance of the inkjet head 1, and then the stopped printing may be restarted.

Further, in the description above, the weight S1 of the ink use amount calculated based on the discharge data calculated in advance is used as the setting reference value of the ink use amount, but the setting reference value of the ink use amount may be calculated based on an ink volume.

As described above, the abnormality of the ink use amount of the inkjet printer 50 configured to perform image forming by discharging the inkjet ink on the web-shaped print base material 2 by the single-pass method can be detected, and hence ink leakage, failure, and the like can be easily found.

REFERENCE SIGNS LIST

1: single-pass inkjet head, 2: web-shaped print base material, 3: feed roll, 4: take-up roll, 5: conveyance motor, 6: drive transmitting unit, 7: purge unit, 8: curing device, drying device, 9, 9*a*, 9*b*, 9*c*, 9*d*, 9*e*: main tank, 10: sub-tank, 11: inkjet ink, aqueous ink, 12: supply path, 13: supply pump, 14: first solenoid valve, 15: second solenoid valve, 16: ink tank mass measuring device, 17: sub-tank liquid level sensor, 18: sub-tank heater, 19, 20: circulation supply path, 21: circulation pump, 22: third solenoid valve, 23: fourth solenoid valve, 24: host computer, 25: apparatus control unit, 26: head control unit, 27: operation panel, 30: CPU, 31: ROM, 32: RAM, 33: interface unit, 50: inkjet printer of the present invention, 52: conveyance mechanism, 54: caster, 56: base, 58*a* to 58*e*: ink tank scale, 60: tube insertion hole.

The invention claimed is:

1. A system of detecting an ink use amount of an inkjet printer configured to perform image forming by discharging an inkjet ink on a web-shaped print base material by a single-pass method, the system of detecting the ink use amount comprising:

an ink tank mass measuring device configured to measure a mass of an ink tank;

a comparison operation device configured to perform a comparison operation between a setting reference value of the ink use amount, which is prepared in advance, and a use amount measurement value of the ink tank mass measuring device; and a display device configured to display a warning when a difference between the use amount measurement value and the setting reference value exceeds a range set in advance.

2. The system of detecting the ink use amount according to claim 1, wherein the setting reference value is calculated based on an ink volume or an ink mass.

3. An inkjet printer, comprising:

the system of detecting the ink use amount of claim 1;

a conveyance mechanism configured to continuously convey the web-shaped print base material;

a single-pass inkjet head configured to discharge an inkjet ink on a surface of the web-shaped print base material conveyed by the conveyance mechanism; and a curing device configured to cure the inkjet ink discharged on the surface of the web-shaped print base material.

4. A method of detecting an ink use amount of an inkjet printer configured to perform image forming by discharging an inkjet ink on a web-shaped print base material by a single-pass method, the method of detecting the ink use amount comprising:

preparing in advance a setting reference value of the ink use amount;

measuring a mass of an ink tank by an ink tank mass measuring device;

performing a comparison operation between the setting reference value of the ink use amount and a use amount measurement value of the ink tank mass measuring device; and displaying a warning when a difference between the use amount measurement value and the setting reference value exceeds a range set in advance.

5. The method of detecting an ink use amount according to claim 4, wherein the setting reference value is calculated based on an ink volume or an ink mass.

* * * * *